US009035694B2

(12) United States Patent
Choi et al.

(10) Patent No.: US 9,035,694 B2
(45) Date of Patent: May 19, 2015

(54) CIRCUIT FOR GENERATING REFERENCE VOLTAGE

(71) Applicant: SAMSUNG ELECTRONICS CO., LTD., Suwon-si, Gyeonggi-do (KR)

(72) Inventors: Michael Choi, Seoul (KR); Marutha Muthu Muthuveeran, Suwon-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/159,670

(22) Filed: Jan. 21, 2014

(65) Prior Publication Data

US 2014/0232453 A1 Aug. 21, 2014

(30) Foreign Application Priority Data

Feb. 20, 2013 (KR) ..... 10-2013-0018092

(51) Int. Cl.
*G05F 1/10* (2006.01)
*G05F 3/16* (2006.01)

(52) U.S. Cl.
CPC ..... *G05F 3/16* (2013.01)

(58) Field of Classification Search
CPC ..... G05F 3/30
USPC ..... 327/512, 513, 539
See application file for complete search history.

(56) References Cited

U.S. PATENT DOCUMENTS

| | | | | |
|---|---|---|---|---|
| 4,857,823 | A | 8/1989 | Bitting | |
| 6,784,652 | B1 | 8/2004 | Aude | |
| 6,815,941 | B2 | 11/2004 | Butler | |
| 7,286,002 | B1 | 10/2007 | Jackson | |
| 7,626,374 | B2 * | 12/2009 | Haiplik | 323/313 |
| 7,675,353 | B1 * | 3/2010 | Mack | 327/539 |
| 7,768,343 | B1 * | 8/2010 | Sinitsky | 327/539 |
| 7,808,305 | B2 * | 10/2010 | Kim et al. | 327/539 |
| 7,944,195 | B2 | 5/2011 | Jang | |
| 8,040,340 | B2 | 10/2011 | Chuang et al. | |
| 2010/0039091 | A1 | 2/2010 | Vidler | |
| 2010/0052644 | A1 | 3/2010 | Ide | |
| 2011/0006749 | A1 | 1/2011 | Stellberger et al. | |
| 2011/0068767 | A1 | 3/2011 | Carper | |

FOREIGN PATENT DOCUMENTS

| | | |
|---|---|---|
| JP | 2003-263232 | 9/2003 |
| JP | 2008-021088 | 1/2008 |
| KR | 1020090024945 | 3/2009 |

* cited by examiner

*Primary Examiner* — Jeffrey Zweizig

(74) *Attorney, Agent, or Firm* — F. Chau & Associates, LLC

(57) ABSTRACT

Provided is a circuit for generating a reference voltage. The circuit includes a band gap circuit generating a first current having a size that increases in proportion to an absolute temperature and a second current having a size that decreases in proportion to the absolute temperature, and outputting a reference voltage based on the first current and the second current; a mirroring circuit mirroring a sum of the first current and the second current and outputting a mirroring voltage that is in proportion to the sum of the first current and the second current; and a start-up circuit receiving the mirroring voltage from the mirroring circuit and providing a driving current for generating the first current or the second current to the band gap circuit until a time when the first current starts to be generated in the band gap circuit.

16 Claims, 11 Drawing Sheets

CIRCUIT FOR GENERATING REFERENCE VOLTAGE

CROSS-REFERENCE TO RELATED APPLICATIONS

This application claims priority to Korean Patent Application No. 10-2013-0018092, filed on Feb. 20, 2013 in the Korean Intellectual Property Office, the disclosure of which is incorporated by reference in its entirety herein.

BACKGROUND

1. Technical Field

Exemplary embodiments of the present invention relate to a circuit for generating a reference voltage.

2. Discussion of Prior Art

With the gradual high integration of an electronic circuit system, various circuits have been integrated into one chip. Among them, an analog circuit requires various DC biases due to the characteristics thereof. Although such DC biases may be separately supplied from outside of the chip, typically a DC bias generating circuit is provided inside the chip to supply the DC biases.

SUMMARY

At least one embodiment of the inventive concept may be used to generate a direct current (DC) bias. As an example, a band gap reference voltage generator can supply a relatively stable bias even if a power supply voltage or a temperature is changed.

When the power is supplied to a semiconductor chip or a system, in an exemplary embodiment, a bias generating circuit, such as the band gap reference voltage generator (e.g., la bias generating circuit using transistors), needs to rapidly get into a steady state to perform an operation that is desired by a circuit designer, so it can be ready to supply a bias to an analog circuit or another circuit.

However, when the power supply is initially applied (e.g., starts), the bias circuit may not be promptly ready to supply the bias, or the operation of the bias circuit itself may not be successful. In an exemplary embodiment of the inventive concept, a start-up circuit is used to make the bias generating circuit enter into a steady state safely and promptly when the power supply to the bias generating circuit starts.

In an exemplary embodiment, the start-up circuit helps the band gap reference voltage generator to perform an initial operation only, and once the circuit reaches the steady state, the start-up circuit is separated from the bias circuit, so that the start-up circuit does not exert an influence on the circuit. Further, in the embodiment, the start-up circuit drives the band gap reference voltage generator until the time when the band gap reference voltage generator generates a desired bias voltage.

According to an exemplary embodiment of the present inventive concept, there is provided a circuit for generating a reference voltage including: a band gap circuit generating a first current having a size that increases in proportion to an absolute temperature and a second current having a size that decreases in proportion to the absolute temperature, and outputting a reference voltage based on the first current and the second current; a mirroring circuit mirroring a sum of the first current and the second current and outputting a mirroring voltage that is in proportion to the sum of the first current and the second current; and a start-up circuit receiving the mirroring voltage from the mirroring circuit and providing a driving current for generating the first current or the second current to the band gap circuit until a time when the first current starts to be generated in the band gap circuit.

According to an exemplary embodiment of the present inventive concept, there is provided a circuit for generating a reference voltage including: a band gap circuit outputting a reference voltage that is in proportion to a size of a driving current that flows through the band gap circuit when the size of the driving current is in a first range, and outputting a constant reference voltage when the size of the driving current is in a second range that is different from the first range; and a start-up circuit providing the driving current to the band gap circuit until the driving current in the second range flows through the band gap circuit.

According to an exemplary embodiment of the present inventive concept, there is provided a circuit for generating a DC bias including: a bias generating circuit, a current mirror circuit, and a start-up circuit. The bias generating circuit is configured to generate internal first and second currents that are proportional to a temperature, and output the DC bias based on the currents. The current mirror circuit is configured to output a mirroring voltage that is in proportion to a sum of the first current and the second current. The start-up circuit is configured to receive the mirroring voltage and apply a driving current to the bias generating circuit only until the first current reaches a predetermined level.

BRIEF DESCRIPTION OF THE DRAWINGS

The present inventive concept will be more apparent from the following detailed description taken in conjunction with the accompanying drawings, in which.

DETAILED DESCRIPTION

Figure 1:
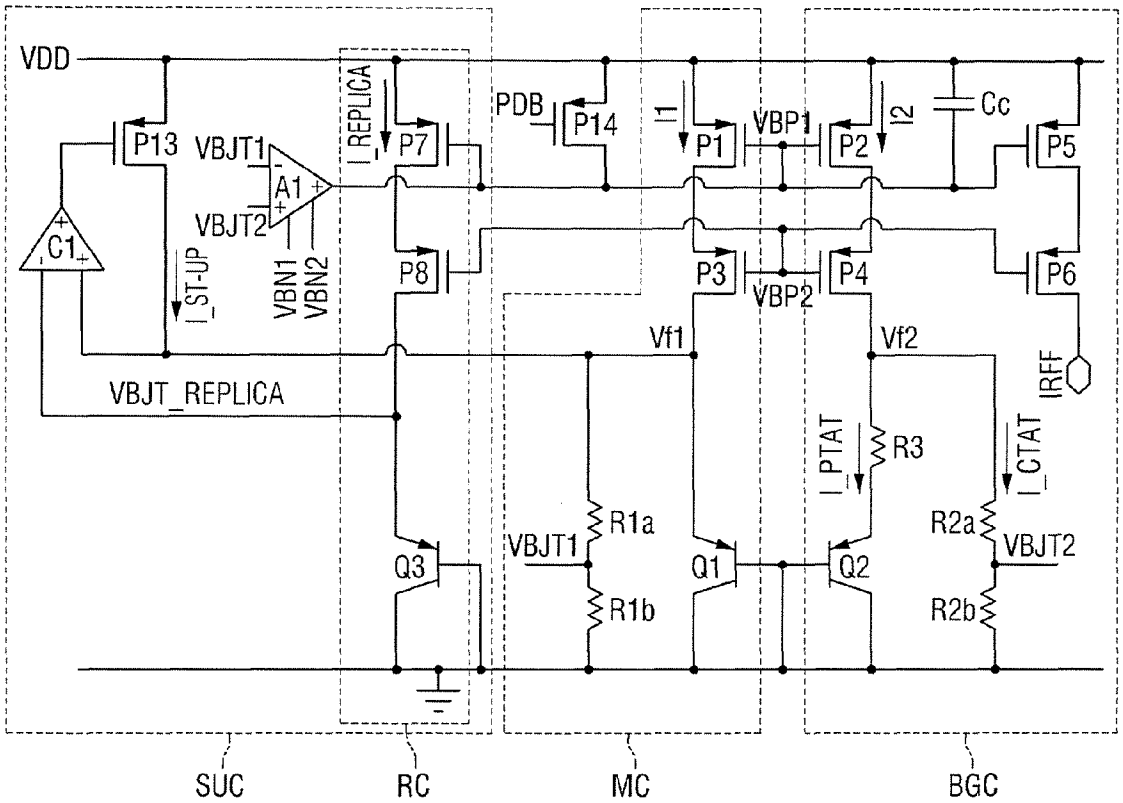
FIG. 1 is a circuit diagram of a circuit for generating a reference voltage according to an exemplary embodiment of the present inventive concept.

The present inventive concept and methods of accomplishing the same may be understood more readily by reference to the following detailed description of exemplary embodiments thereof and the accompanying drawings. The present inventive concept may, however, be embodied in many different forms and should not be construed as being limited to the exemplary embodiments set forth herein. In the drawings, the thickness of layers and regions may be exaggerated for clarity.

It will be understood that when an element or layer is referred to as being "on" or "connected to" another element or layer, it can be directly on or connected to the other element or layer or intervening elements or layers may be present. Like numbers refer to like elements throughout. The use of the terms "a" and "an" and "the" in the context of describing the invention are to be construed to cover both the singular and the plural, unless otherwise indicated herein or clearly contradicted by context Hereinafter, referring to FIGS. 1 and 2, a circuit for generating a reference voltage according to an exemplary embodiment of the present inventive will be described.

Figure 2:
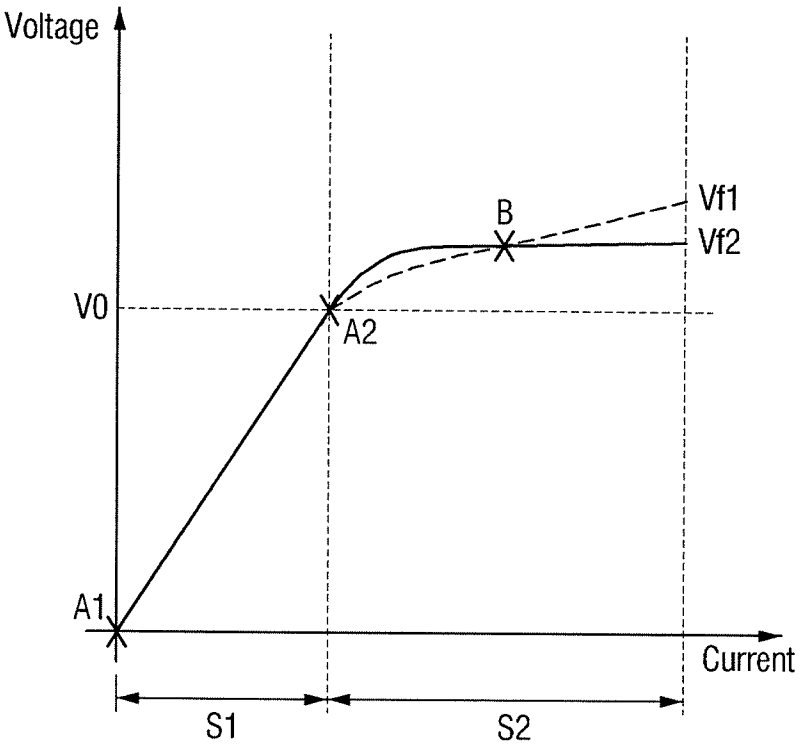
FIG. 2 is a diagram illustrating an exemplary output of a band gap circuit of FIG. 1.

FIG. 1 is a circuit diagram of a circuit for generating a reference voltage according to an exemplary embodiment of the present invention, and FIG. 2 is a diagram illustrating an exemplary output of a band gap circuit (BGC) of FIG. 1. FIG. 1 includes a band gap (BGC) circuit, a mirroring circuit MC, and a start-up circuit SUC. The BGC includes transistor P2 receiving voltage VBP1, transistor P4 receiving voltage VBP2, transistor P5, transistor P6 outputting a current IRFF, transistor Q2, capacitor Cc, and resistors R3, R2*a*, and R2*b*. The MC includes transistor P1 receiving voltage VBP1, transistor P3 receiving voltage VBP2, transistor Q1, and resistors R1*a* and R1*b*. The SUC includes a transistor P13, a comparator C1, an operational amplifier A1, and a replica (RC) circuit. In an exemplary embodiment, power supply terminals of the operational amplifier A1 receive signals VBN1 and VBN2, respectively. The RC includes transistor P7, transistor P8, and transistor Q7. FIG. 1 further includes transistor P14, which receives voltage PDB.

The band gap circuit (BGC) is a circuit for generating a DC bias (for example, a reference voltage) that is supplied to a device, and is a circuit, which generates a first current (for example, PTAT (Proportional To Absolute Temperature) current I_CTAT) having a size that increases in proportion to an absolute temperature and a second current (for example, CTAT (Complementary To Absolute Temperature) current I_CTAT) having a size that decreases in proportion to the absolute temperature, and outputs a reference voltage based on the first current and the second current. The reference voltage may be output by an output node of the BGC, such as the output terminal of P6. For example, if the absolute temperature increases from 1 degree Celsius to 2 degrees Celsius, the first current could increase from 1 milliamp (MA) to 2 MA, while the second current could decrease from 3 MA to 2 MA. Please note that this provided example is not necessarily representative of the actual currents produced by the BGC circuit, as the first and second current may vary based considerably based on the elements chosen to construct the BGC circuit.

The band gap circuit (BGC) according to an exemplary embodiment may have a different reference operation state depending on the size of a driving current (here, the driving current I2 may be a sum of the first current I_PTAT and the second current I-CTAT as described above) that flows through the band gap circuit, and a final output voltage of the band gap circuit BGC may be determined depending on the operation state of the band gap circuit.

Referring to FIG. 2, if the size of the driving current I2 that flows through the band gap circuit BGC is in a first section S1, the band gap circuit BGC outputs a node voltage A1 to A2 that is in proportion to the size of the driving current I2, while if the size of the driving current I2 is in a second section S2, the band gap circuit BGC outputs a constant node voltage B regardless of the size of the driving current I2. For example, if the size of the driving current I2 that flows through the band gap circuit is in the first section S1, the output of the band gap circuit BGC is determined as any one of A1 to A2 depending on the size of the driving current I2, whereas if the size of the driving current I2 is in the second section S2, the output of the band gap circuit BGC is fixed to the node voltage B regardless of the size of the driving current I2. The first section Si may be referred to as a first range and the second section S2 may be referred to as second range. For example, prior to entering a steady-state, the driving current I2 may be one of a range of current values of the first range, where each next higher value of the first range corresponds to a linearly increasing output voltage of the BGC, and after entering the steady-state, the driving current I2 may be one of a range of current values of the second range, where each next higher value of the second range corresponds to a constant output of the BGC. In an exemplary embodiment, the driving current may be one of a range of current values of third range during a first part of section S2 after section S1 that corresponds to a transition state. For example, in the transition state, each next higher value of the third range may correspond to a non-linearly increasing output voltage of the BGC. The band gap circuit BGC may supply a stable reference voltage due to the fixed node voltage B, which will be described in more detail below.

When the driving current I2 in the first section S1, which has a relatively small size, flows in the band gap circuit BGC, a voltage Vf2 at a second node is not high enough to turn on a second P-type BJT (Bipolar Junction Transistor) Q2, and thus the second BJT Q2 is kept in a turn-off state. Accordingly, in the band gap circuit BGC, the first current I_PTAT does not flow, and only the second current I_CTAT flows. At this time, the output voltage of the band gap circuit BGC becomes a second current×a second resistance (e.g., I_CTAT×(R2*a*+R2*b*)), and as the size of the second current I_CTAT is increased, the size of the corresponding node voltage is also increased (see S1 in FIG. 2). In an exemplary embodiment, resistor R2*a* and R2*b* can be replaced with a single resistor R2 (not shown).

However, if the current in the second section S2, which has a relatively large size, flows in the band gap circuit BGC, the voltage Vf2 at the second node becomes high enough to turn on the second BJT Q2 (Vf2 in FIG. 1>V0 in FIG. 2), and thus the second BJT Q2 is turned on to make the first current I_PTAT flow in the band gap circuit BGC. Here, since the first current I_PTAT and the second current I_STAT are in complementary relations, the node voltage of the band gap circuit BGC is stabilized to B with the lapse of time (see S2 in FIG. 2).

In consideration of the operating characteristics of the band gap circuit BGC, in an exemplary embodiment, the band gap circuit BGC may reliably generate the reference voltage when the following conditions are present.

(Condition 1) If the second node voltage Vf2 of the band gap circuit BGC is not high enough to turn on the second BJT Q2 (Vf2<V0), it is necessary to continuously provide the driving current I2 to the band gap circuit BGC.

(Condition 2) If the second node voltage Vf2 becomes high enough to turn on the second BJT Q2 (Vf2≥V0), it is necessary that the start-up circuit is separated from the band gap circuit BGC in operation (e.g., when operating in a steady-state).

The circuit for generating a reference voltage according to an exemplary embodiment may include a mirroring circuit MC and a start-up circuit SUC designed to satisfy the above-described conditions. Hereinafter, these circuits will be described in detail.

Referring again to FIG. 1, the mirroring circuit MC performs mirroring of a sum of the first current I_PTAT and the second current I_STAT, which flow through the band gap circuit BGC and outputs a mirroring voltage Vf1 that is in proportion to the sum of the first current I_PTAT and the second current I_CTAT. In this embodiment, the mirroring circuit MC may be a current mirror circuit, but the present inventive concept is not limited thereto.

As illustrated in FIG. 1, the mirroring circuit MC is configured to include a first PMOS transistor P1 that corresponds to a second PMOS transistor P2 of the band gap circuit BGC, a third PMOS transistor P3 that corresponds to a fourth PMOS transistor P4 of the band gap circuit BGC, and a first P-type BJT Ql that corresponds to a second BJT Q2 of the band gap circuit BGC, which are connected between the power supply voltage VDD and a ground terminal. The ground terminal may provide a ground voltage that is lower than the power supply voltage VDD.

Here, a mirroring current I1 that flows through the mirroring circuit MC corresponds to the driving current I2 that flows through the band gap circuit BGC, and the mirroring voltage Vf1 that is applied to a first node corresponds to the voltage that is applied to a second node of the band gap circuit BGC.

The start-up circuit SUC receives the mirroring voltage Vf1 from the mirroring circuit MC and provides the driving current I2 for generating the first current I_PTAT or the second current I_CTAT to the band gap circuit BGC until a time when the first current I_PTAT starts to be generated in the band gap circuit BGC (that is, a time when the driving current in the second section (S2 in FIG. 2) flows through the band gap circuit BGC). In other words, in order to satisfy the above-described conditions 1 and 2, the start-up circuit SUC according to this embodiment continuously provides the driving current I2 to the band gap circuit BGC if the second node voltage Vf2 of the band gap circuit BGC is not high enough to turn on the second BJT Q2 (Vf2<V0), and the start-up circuit SUC is separated from the band gap circuit BGC in operation if the second node voltage V12 of the band gap circuit BGC becomes high enough to turn on the second BJT Q2 (Vf2 V0).

In order to perform such an operation, in an exemplary embodiment of the present inventive concept, the start-up circuit SUC includes a replica circuit RC, a comparator C1, a driving transistor P13, and an operational amplifier A1.

The replica circuit RC includes a third BJT Q3, which may be the same as the second BJT Q2 that is included in the band gap circuit BGC. As illustrated, the replica circuit RC is configured to include a seventh PMOS transistor P7 that corresponds to the second PMOS transistor P2 of the band gap circuit BGC or the first PMOS transistor P1 of the mirroring circuit MC, an eighth PMOS transistor P8 that corresponds to the fourth PMOS transistor P4 of the band gap circuit BGC or the third PMOS transistor P3 of the mirroring circuit MC, and the third P-type BJT Q3 that corresponds to the second BJT Q2 of the band gap circuit BGC or the first BJT Q1 of the mirroring circuit MC, which are connected between the power supply voltage VDD and the ground terminal.

Here, a replica voltage VBJT_REPLICA, which the replica circuit RC outputs to the comparator C1, is a voltage for turning on the third BJT Q3. In this embodiment, since the third BJT Q3 corresponds to the second BJT Q2 of the band gap circuit BGC or the first BJT Q1 of the mirroring circuit MC, the replica voltage VBJT_REPLICA is a voltage for turning on the second BJT Q2 of the band gap circuit BGC or the first BJT Q1 of the mirroring circuit MC.

The comparator C1 receives the replica voltage VBJT_REPLICA from the replica circuit RC and the mirroring voltage Vf1 from the mirroring circuit MC, compares sizes of the received voltages with each other, and provides different output signals to the driving transistor P13 according to the compare.

In an exemplary embodiments of the present inventive concept, when the driving transistor P13 is a PMOS transistor as illustrated, the comparator C1 outputs a low-level signal to the driving transistor P13 to turn on the driving transistor P13 if the mirroring voltage Vf1 is lower than the replica voltage VBJT_REPLICA, and outputs a high-level signal to the driving transistor P13 to turn off the driving transistor P13 if the mirroring voltage Vf1 is higher than the replica voltage VBJT_REPLICA.

However, due to a process variation that may occur in a fabricating process or the like, the driving current I2 in the band gap circuit BGC may not be sufficient enough to turn on the second BJT Q2 even when the comparator C1 determines that the mirroring voltage Vf1 is higher than the replica voltage VBJT_REPLICA and turns off the driving transistor P13. In this situation, the above-described condition 2 is unable to be satisfied, on which the start-up circuit SUC is separated from the band gap circuit BGC in operation if the second node voltage Vf2 of the band gap circuit BGC becomes high enough to turn on the second BJT Q2 (V12≥V0).

Accordingly, the comparator C1 according to this embodiment further considers an offset voltage based on influence of the process variation. For example, if the mirroring voltage Vf1 is lower than the sum of the replica voltage VBJT_REPLICA and the offset voltage that is set based on the process variation, the comparator C1 turns on the driving transistor P13 to provide the driving current I2 to the band gap circuit BGC. However, if the mirroring voltage Vf1 is higher than the sum of the replica voltage VBJT_REPLICA and the offset voltage, the comparator C1 turns off the driving transistor P13, so that the start-up circuit SUC is separated from the band gap circuit BGC in operation. In an exemplary embodiment, the considered offset voltage, which has a value including the dispersion of the offset voltage itself, is larger than a value that is obtained by subtracting the mirroring voltage Vf1 from the replica voltage VBJT_REPLICA, but is smaller than a value that is obtained by subtracting the turn-on voltage of the BJT from the replica voltage VBJT_REPLICA. In accordance with the operation of the start-up circuit SUC as described above, the circuit for generating a reference voltage according to this embodiment can satisfy both the above-described conditions 1 and 2 even if the process variation occurs in the fabricating process, and thus the band gap circuit BGC can generate the reference voltage more reliably.

Various implementations of the comparator C1 that performs the above-described operation may be used. Hereinafter, referring to FIG. 3, one exemplary configuration of the comparator C1 will be explained. However, the present inventive concept is not limited to the configuration illustrated in FIG. 3.

Figure 3:
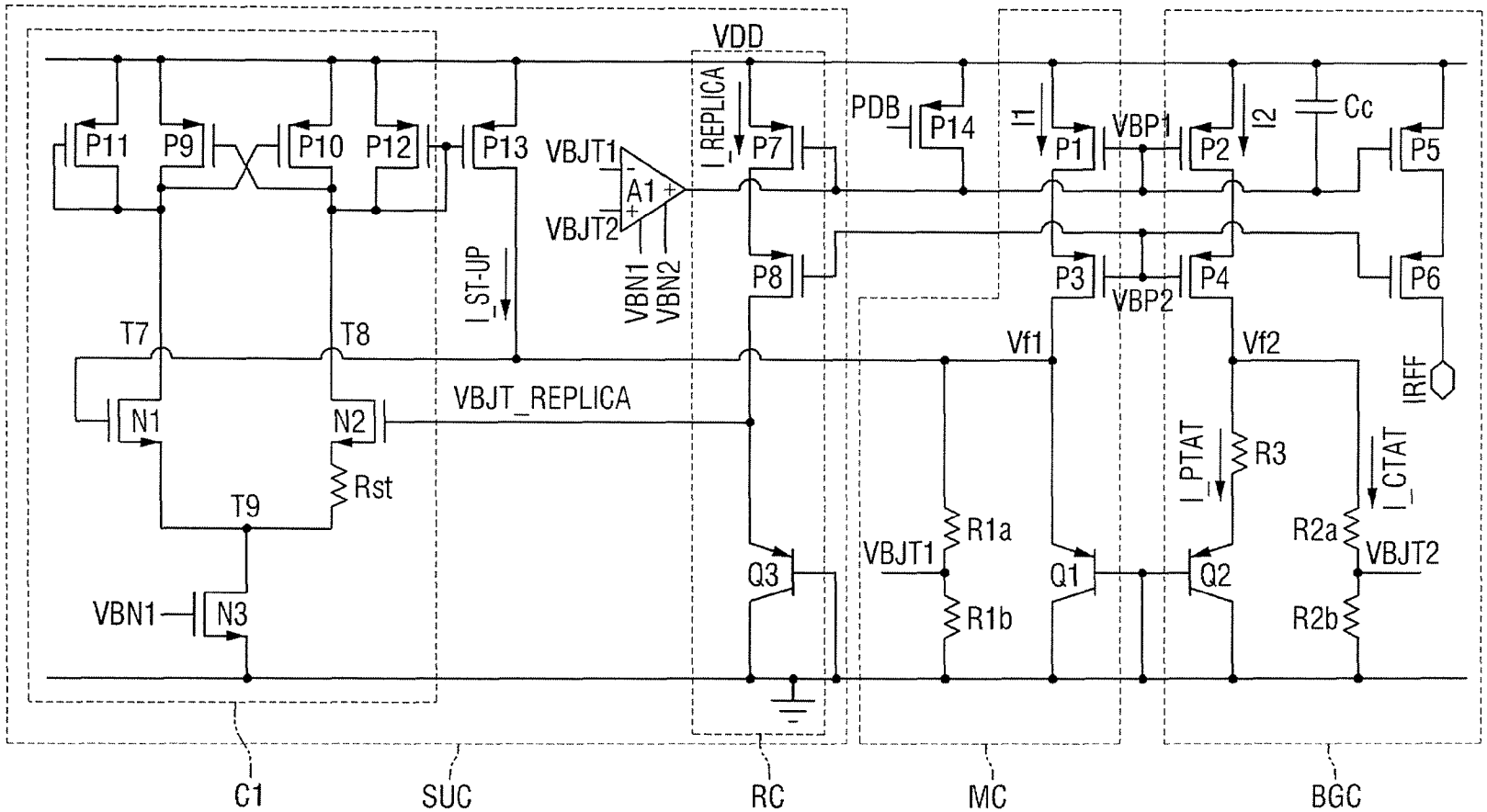
FIG. 3 is a circuit diagram of a comparator of FIG. 1 according to an exemplary embodiment of the inventive concept.

FIG. 3 is an exemplary circuit diagram of the comparator of FIG. 1.

Referring to FIG. 3, the comparator C1 includes a second NMOS transistor N2 having a gate terminal that receives the replica voltage VBJT_REPLICA from the replica circuit RC and connected in series to an offset resistor RST that is related to the offset voltage as described above, a first NMOS transistor N1 having a gate terminal that receives the mirroring voltage Vf1 from the mirroring circuit MC, a plurality of PMOS transistors P9 to P12 related to the driving of the above-described NMOS transistors, and a transistor N3 receiving a voltage VBN 1. The operation of the comparator C1 having the above-described configuration will be described later.

Referring again to FIG. 1, the driving transistor P13 determines whether to provide the driving current I2 to the band gap circuit BGC in accordance with the output signal of the comparator C1, and the operational amplifier A1 is self-biased and turns on the switch (for example, P2) included in the band gap circuit BGC to provide the driving current I2 to the band gap circuit BGC if the driving transistor P13 is turned on. The operations of the driving transistor P13 and the operational amplifier A1 will also be described later.

Hereinafter, referring to FIGS. 4 to 6, the operation of the circuit for generating a reference voltage according to an exemplary embodiment of the present inventive concept will be described in more detail.

Figure 4:
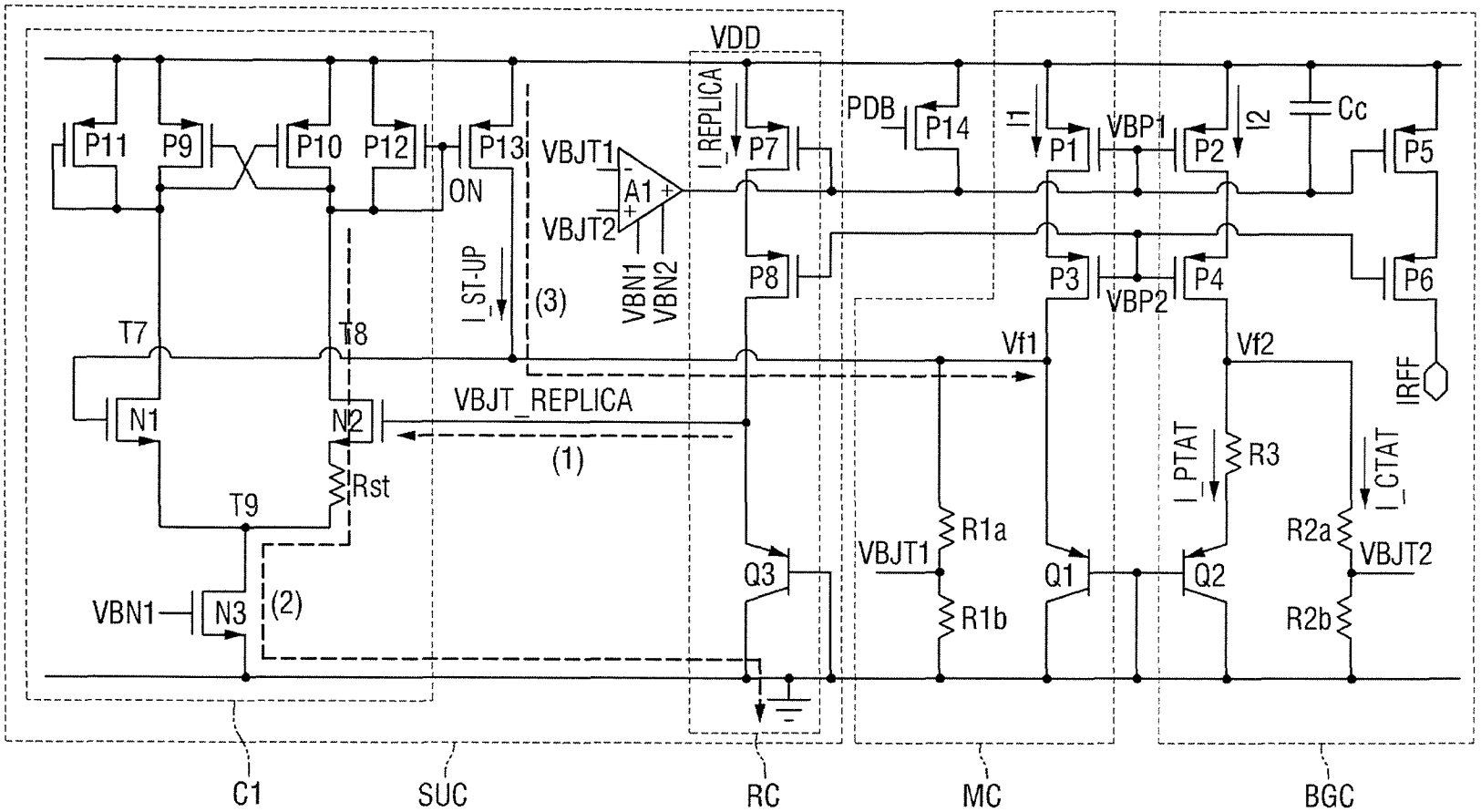
FIGS. 4 to 6 are diagrams explaining the operation of a circuit for generating a reference voltage according to an exemplary embodiment of the present inventive concept.
Figure 5:
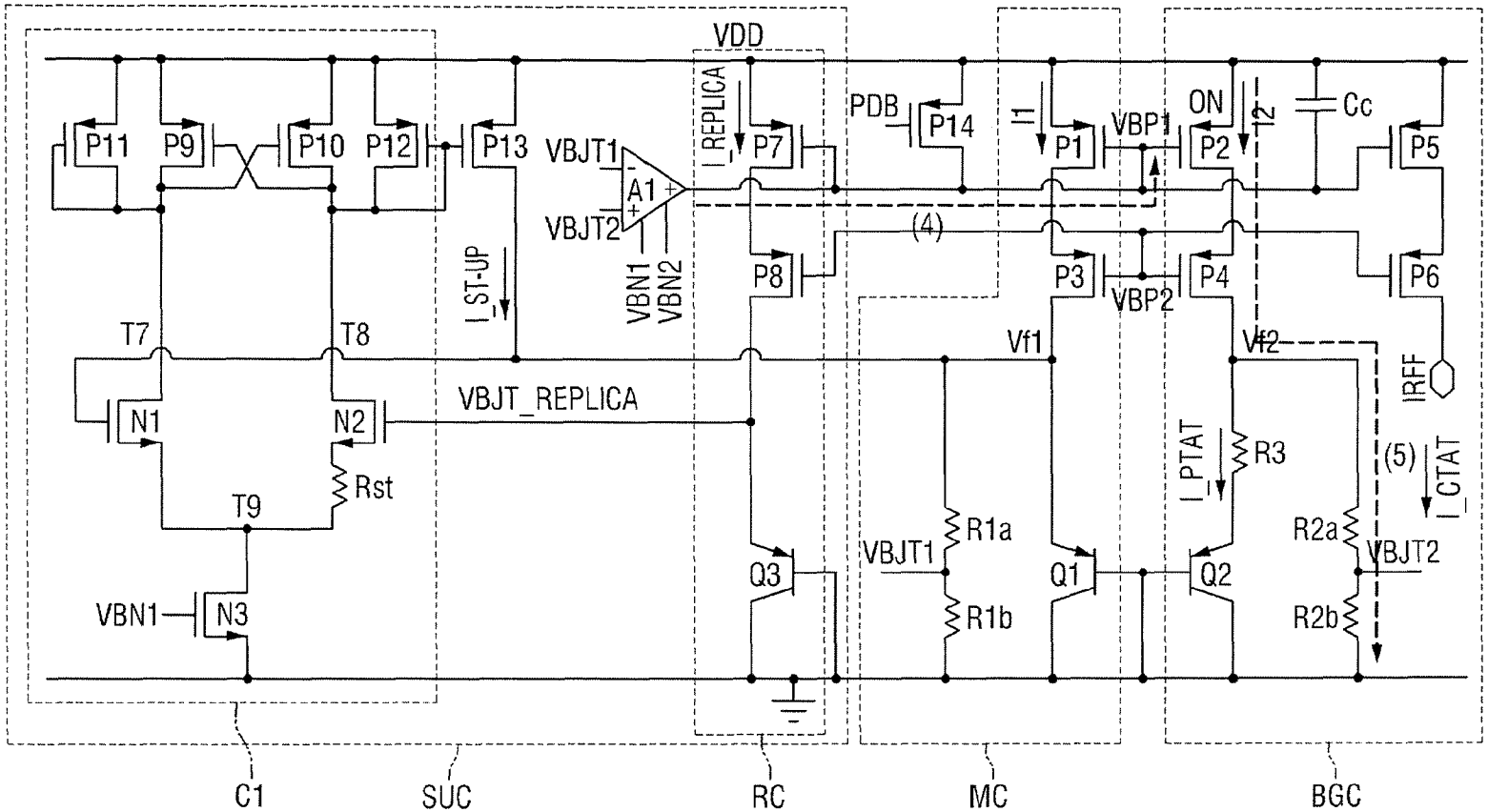
Figure 6:
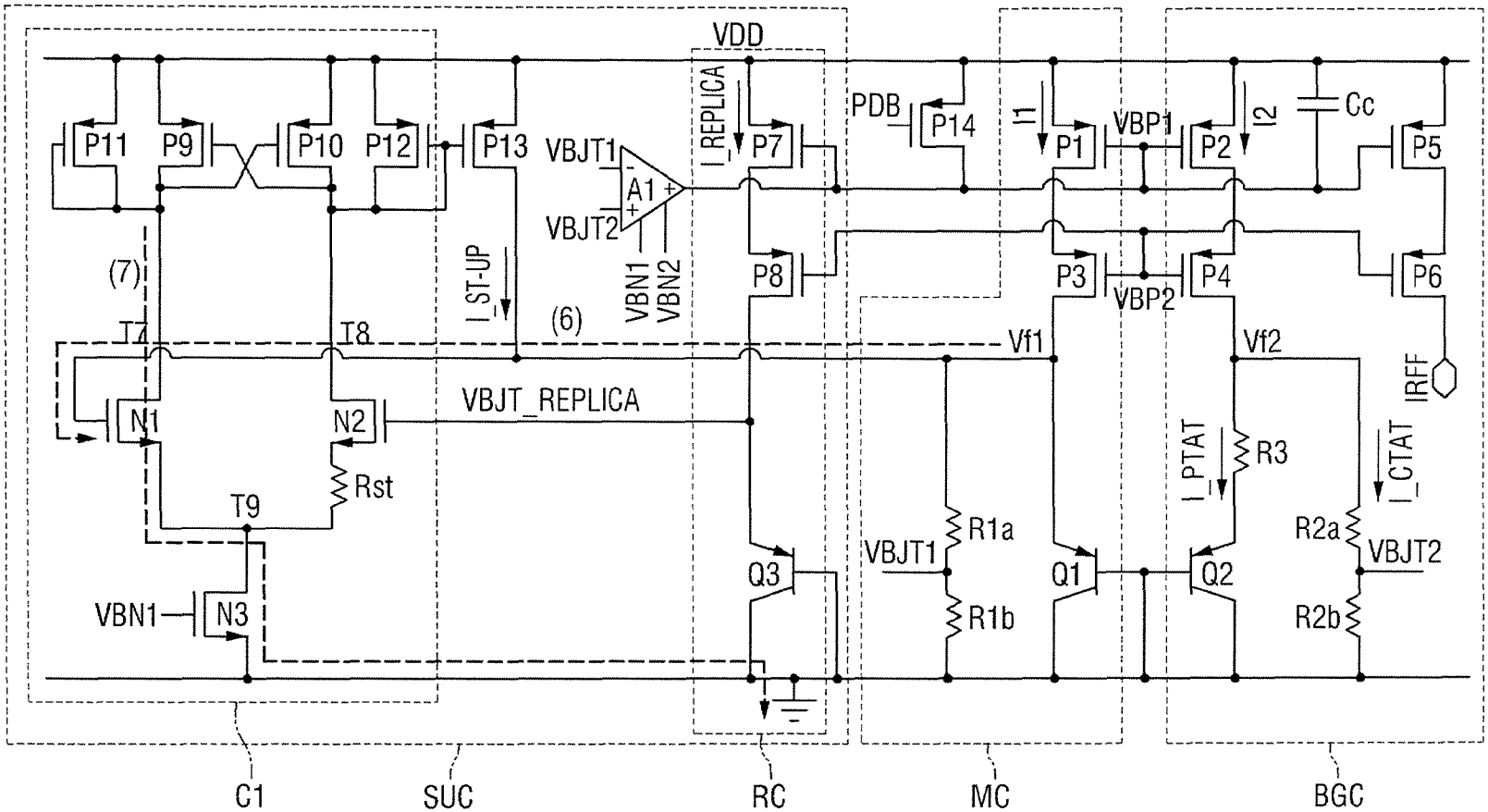

FIGS. 4 to 6 are diagrams explaining the operation of a circuit for generating a reference voltage according to an exemplary embodiment of the present inventive concept.

First, referring to FIG. 4, in an initial state where the band gap circuit BGC is not driven, the mirroring voltage Vf1 that is applied to the comparator C1 is lower than the replica voltage VBJT_REPLICA. Accordingly, the replica voltage VBJT_REPLICA turns on the second NMOS transistor N2 of the comparator C1 (see (I)). If the second NMOS transistor N2 is turned on, a path is formed between an eighth node T8 and the ground terminal, and the voltage at the eighth node T8 is pulled down (see (2)). Accordingly, the driving transistor P13 is turned on to provide a start-up current I_ST-UP to the mirroring circuit MC, and thus the mirroring voltage Vf1 and the first BJT voltage VBJT1 are increased (see (3)).

Next, referring to FIG. 5, although the first BJT voltage VBJT1 is increased by the provided start-up current I_ST-UP, the driving current I2 is not provided to the band gap circuit BGC, and thus the second BJT voltage VBJT2 is not increased, but is still in a low-voltage state. Accordingly, the operational amplifier A1 pull downs the voltage VBP1 that is applied to the gate terminals of the first PMOS transistor P1 and the second PMOS transistor P2, and thus the first, second, fifth, and seventh PMOS transistors P1, P2, P5, and P7 are turned on (see (4)). If the second PMOS transistor P2 that serves as a switch is turned on, the driving current I2 is supplied to the band gap circuit BGC, and the band gap circuit BGC generates the reference voltage of A1 to A2 of FIG. 2 as the driving current I2 is increased (see (5)). The operational amplifier A1 may receive the first BJT voltage VBJT1 from a node between resistor R1*a* and R1*b* and the second BJT voltage VBJT2 from a node between resistor R2*a* and R2*b*.

Next, referring to FIG. 6, if the size of the driving current I2 that flows in the band gap circuit BGC is continuously increased to reach the second section S2 of FIG. 2, the size of the mirroring voltage Vf1 that mirrors the driving current I2 reaches the size of the replica voltage VBJT_REPLICA. That is, the size of the mirroring voltage Vf1 is increased enough to turn on the first BJT Q 1. However, according to this embodiment, the offset voltage is additionally considered to minimize the influence of the process variation as described above, and if the mirroring voltage Vf1 becomes higher than the sum of the replica voltage VBJT_REPLICA and the offset voltage by the offset resistor Rst (see (6)), the seventh node T7 is pulled down (see (7)). As described above, the considered offset voltage, which has a value including the dispersion of the offset voltage itself, is larger than a value that is obtained by subtracting the mirroring voltage Vf1 from the replica voltage VBJT_REPLICA, but is smaller than a value that is obtained by subtracting the turn-on voltage of the BJT from the replica voltage VBJT_REPLICA. At this time, the eighth node T8 is pulled up to the power supply voltage VDD due to the influence of the offset resistor Rst, and thus the driving transistor P13 is turned off. Accordingly, if the second node voltage Vf2 of the band gap circuit BGC reaches a threshold voltage (V0 in FIG. 2) that can turn on the second BJT Q2, the start-up circuit SUC is separated from the band gap circuit BGC in operation so that the band gap circuit BGC can output the constant reference voltage (B in FIG. 2) regardless of the size of the driving current I2.

Through the above-described configuration, the start-up circuit according to at least one embodiment of the inventive concept can satisfy both the above-described conditions 1 and 2, and thus the band gap circuit BGC can reliably generate the reference voltage.

Hereinafter, referring to FIG. 7, a circuit for generating a reference voltage according to an exemplary embodiment of the present inventive concept will be described.

Figure 7:
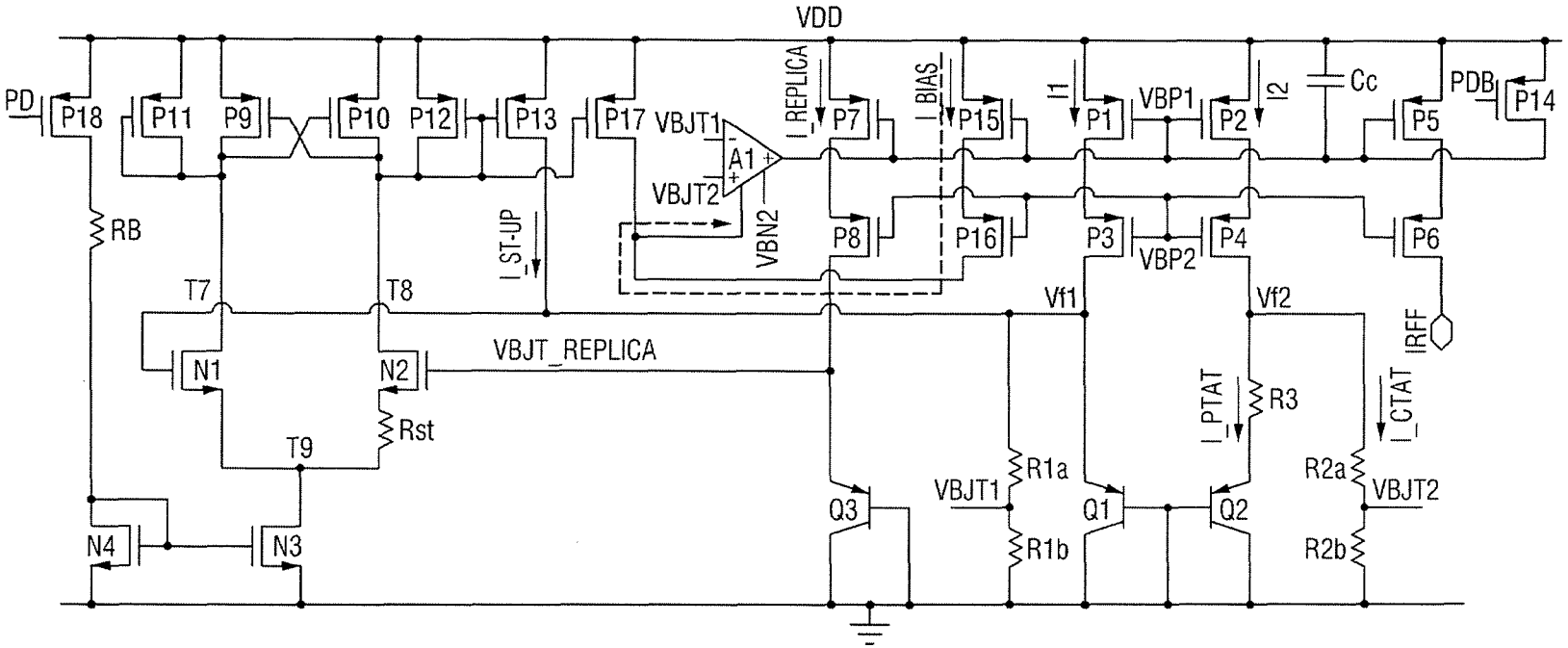
FIG. 7 is a circuit diagram of a circuit for generating a reference voltage according to an exemplary embodiment of the present inventive concept.

FIG. 7 is a circuit diagram of a circuit for generating a reference voltage according to an exemplary embodiment of the present inventive concept. Hereinafter, duplicate explanations of the same elements discussed above with respect to the above-described embodiment will be omitted, and an explanation will be made primarily with respect to a difference between the embodiments.

Referring to FIG. 7, unlike the above-described embodiment, the operational amplifier A1 of the circuit for generating a reference voltage according to this embodiment is biased by the driving current I2 that flows in the band gap circuit BGC. More specifically, the operational amplifier A1 of the circuit for generating a reference voltage according to this embodiment is biased by the same bias current I_BIAS as the driving current I2 that flows in the band gap circuit BGC. For such biasing of the operational amplifier A1, the circuit for generating a reference voltage according to this embodiment additionally includes a biasing circuit that includes fifteenth to seventeenth PMOS transistors P15 to P17 as illustrated. FIG. 7 further includes a transistor P18 receiving a voltage PD, transistor N4, and resistor RB connected between transistors P18 and N4.

Since other elements and their operations of the circuit for generating a reference voltage are the same as those according to the above-described embodiment, a duplicate explanation thereof will be omitted.

Next, referring to FIG. 8, a memory device that adopts the circuit for generating a reference voltage according to an exemplary embodiment of the present inventive concept will be described.

Figure 8:
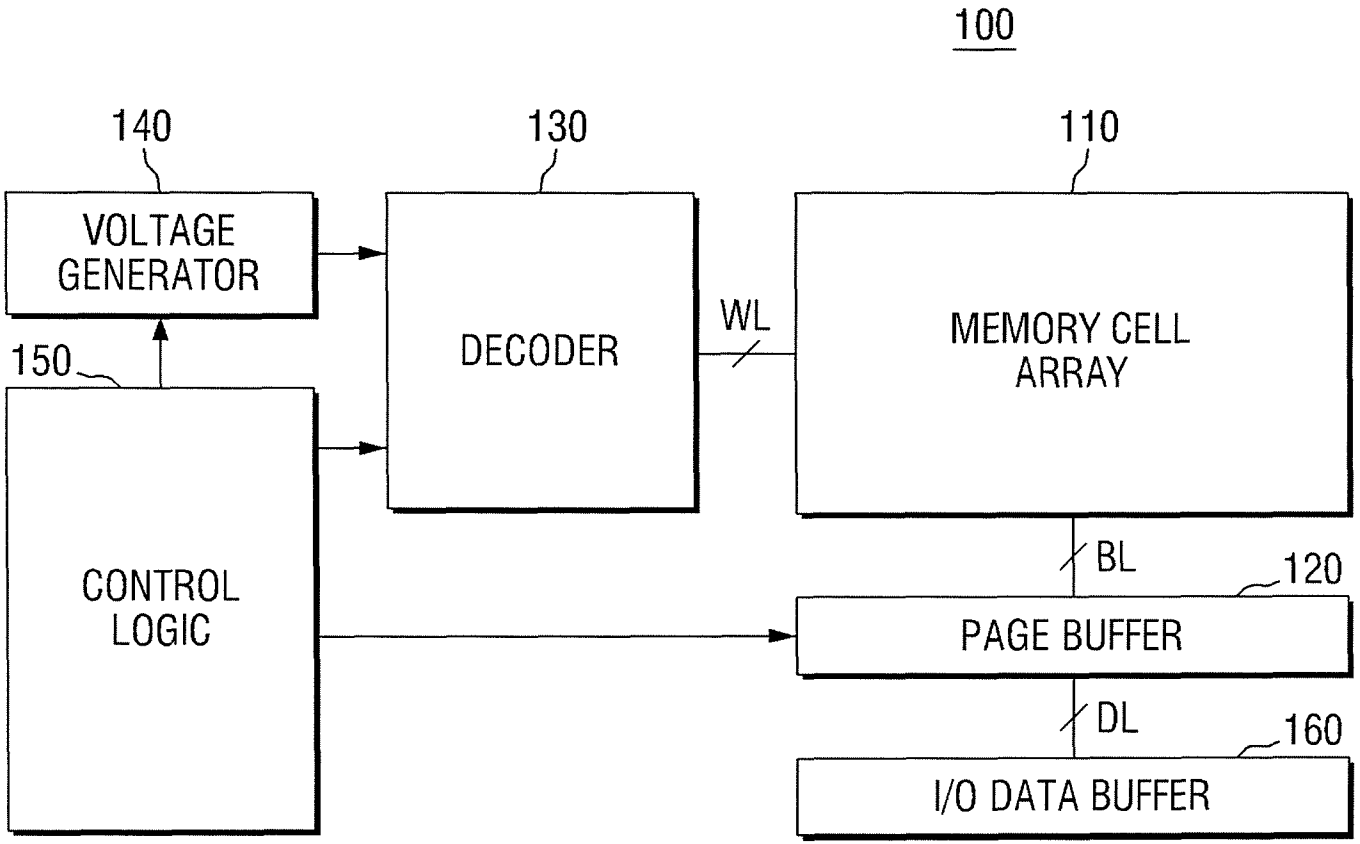
FIG. 8 is a block diagram of a memory device adopting a circuit for generating a reference voltage according to an exemplary embodiment of the present inventive concept.

FIG. 8 is a conceptual block diagram of a memory device adopting the circuit for generating a reference voltage according to an exemplary embodiment of the present inventive concept.

Referring to FIG. 8, a memory device 100 may be, for example, a nonvolatile memory device. For example, the memory device 100 may be a flash memory device. For example, the memory device may be any one of a NAND flash memory device and a NOR flash memory device.

However, the type of the memory device according to the technical features of the present inventive concept is not limited thereto. In an exemplary embodiment of the present inventive concept, the memory device 100 includes at least one of a PRAM (Phase-change Random-Access Memory), an MRAM (Magneto-resistive Random-Access Memory, and a RRAM (Resistive Random-Access Memory).

Referring again to FIG. 8, the memory device 100 includes a memory cell array 110. The memory cell array 110 may include at least one memory cell (not illustrated). Each memory cell (not illustrated) may store n-bit data information (where, n is 1 or an integer that is larger than 1). The memory cell array 110 may be divided into a plurality of regions. For example, the memory cell array 110 may include a data region where general data is stored and a spare region. For example, the spare region may be reserved for special data. Each region of the memory cell array 110 may be composed of a plurality of memory blocks As illustrated in FIG. 8, the memory device 100 further includes a page buffer 120, a decoder 130, a voltage generator 140, a control logic (e.g., a controller) 150, and an input/output (I/O) data buffer 160.

The page buffer 120 may be configured to write data on memory cells (not illustrated) included in the memory cell array 110 or to read the data from the memory cells (not illustrated) under the control of the controller 150.

The decoder 130 is controlled by the controller 150, and may be configured to select a memory block of the memory cell array 110 and to select a word line WL of the selected memory block. The word line WL selected by the decoder 130 may be driven by a word line voltage generated from the voltage generator 140.

The voltage generator 140 is controlled by the controller 150, and may be configured to regulate the provided reference voltage to the word line voltage (for example, a read voltage, a write voltage, a pass voltage, a local voltage, a verification voltage, and the like) to be supplied to the memory cell array 110. Here, in generating a reference voltage that is provided to the voltage generator 140, the circuit for generating a reference voltage according to at least one embodiment of the present inventive concept as described above may be adopted.

The I/O data buffer 160 receives an input of the read result from the page buffer 120 to output the read result to the outside, and transfers the data transmitted from the outside to the page buffer 120. The controller 150 may be configured to control the whole operation of the memory device 100.

Next, referring to FIGS. 9 to 11, a memory system according to an exemplary embodiment of the present inventive concept and application examples thereof will be described.

Figure 9:
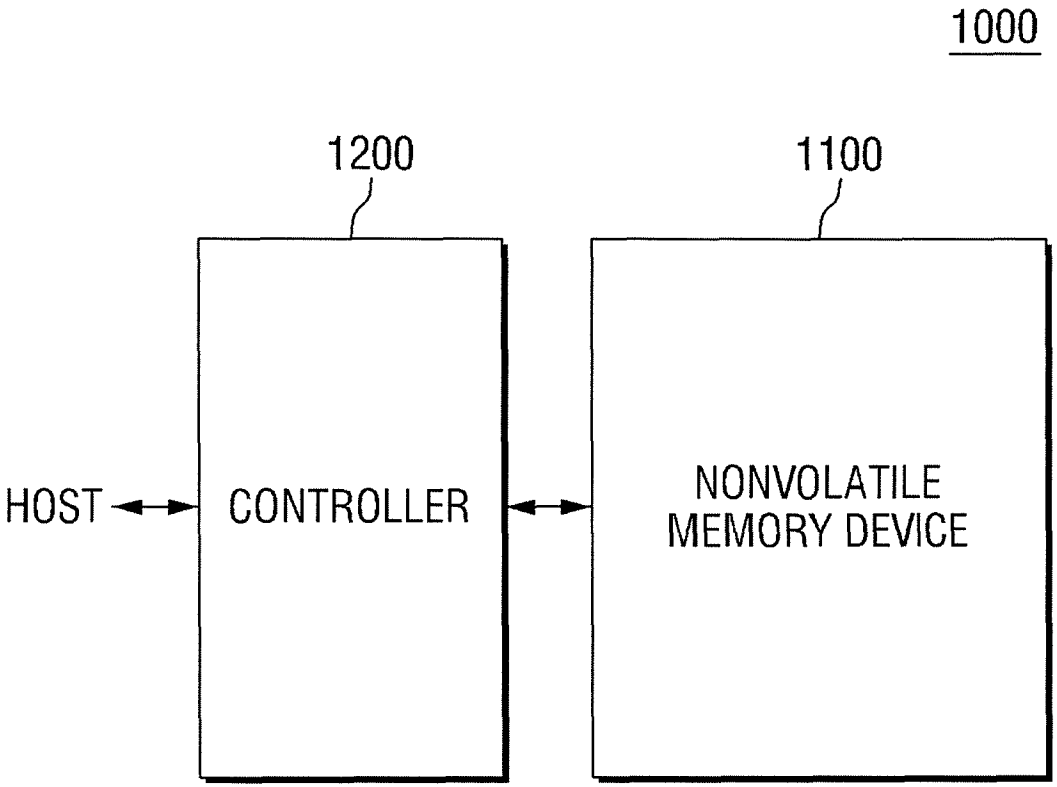
FIG. 9 is a block diagram explaining a memory system adopting a circuit for generating a reference voltage according to an exemplary embodiment of the present inventive concept.

FIG. 9 is a block diagram explaining a memory system adopting a circuit for generating a reference voltage according to an exemplary embodiment of the present inventive concept. FIG. 10 is a block diagram illustrating an application example of the memory system of FIG. 9. FIG. 11 is a block diagram illustrating a computing system including the memory system explained with reference to FIG. 10.

Referring to FIG. 9, a memory system 1000 includes a nonvolatile memory device 1100 and a controller 1200.

Here, the nonvolatile memory device 1100 may be a memory device (e.g., 100 in FIG. 8) that adopts the circuit for generating a reference voltage according to an exemplary embodiment of the present inventive concept.

The controller 1200 is connected to a host and the nonvolatile memory device 1100. The controller 1200 is configured to access the nonvolatile memory device 1100 in response to a request from the host. For example, the controller 1200 is configured to control read, write, erase, and background operations of the nonvolatile memory device 1100. The controller 1200 is configured to provide an interface between the nonvolatile memory device 1100 and the host. The controller 1200 may be configured to drive firmware to control the nonvolatile memory device 1100.

As an example, the controller 1200 may further include elements, such as a RAM (Random Access Memory), a processing unit (a central processing unit, a graphics processing unit), a host interface, and a memory interface. The RAM may be used as at least one of an operating memory of the processing unit, a cache memory between the nonvolatile memory device 1100 and the host, and a buffer memory between the nonvolatile memory device 1100 and the host. The processing unit may control the overall operation of the controller 1200.

The host interface includes a protocol for performing data exchange between the host and the controller 1200. As an example, the controller 1200 may be configured to communicate with the outside (e.g., a host) through at least one of various interface protocols, such as a USB (Universal Serial Bus) protocol, an MMC (Multimedia Card) protocol, a PCI (Peripheral Component Interconnection) protocol, a PCI-E (PCI-Express) protocol, an ATA (Advanced Technology Attachment) protocol, a serial-ATA protocol, a parallel-ATA protocol, an SCSI (Small Computer Small Interface) protocol, an ESDI (Enhanced Small Disk Interface) protocol, and an IDE (Integrated Drive Electronics) protocol. The memory interface interfaces with the nonvolatile memory device 1100. For example, the memory interface may include a NAND interface or a NOR interface.

The memory system 1000 may be configured to additionally include an error correction block. The error correction block may be configured to detect and correct an error of data that is read from the nonvolatile memory device 1100 using an error correction code (ECC). As an example, the error correction block may be provided as an element of the controller 1200. As another example, the error correction block may be provided as an element of the nonvolatile memory device 1100.

The controller 1200 and the nonvolatile memory device 1100 may be integrated into one semiconductor device. As an example, the controller 1200 and the nonvolatile memory device 1100 may be integrated into one semiconductor device to form a memory card. For example, the controller 1200 and the nonvolatile memory device 1100 may be integrated into one semiconductor device to form a memory card, such as a PC card (PCMCIA (Personal Computer Memory Card International Association)), a compact flash (CF) card, a smart media card (SM or SMC), a memory stick, a multimedia card (MMC, RS-MMC, MMCmicro), an SD card (SD, miniSD, microSD, or SDHC), a universal flash storage device (UFS), or the like.

The controller 1200 and the nonvolatile memory device 1100 may be integrated into one semiconductor device to form an SSD (Solid State Drive). The SSD includes a storage device that is configured to store data in a semiconductor memory. When the memory system 1000 is used as the SSD, the operating speed of the host that is connected to the memory system 1000 may be improved.

As another example, the memory system 1000 may be provided as one of various elements of electronic devices, such as a computer, a UMPC (Ultra Mobile PC), a work station, a net-book, a PDA (Personal Digital Assistants), a portable computer, a web tablet, a wireless phone, a mobile phone, a smart phone, an e-book, a PMP (Portable Multimedia Player), a portable game machine, a navigation device, a black box, a digital camera, a 3-dimensional television receiver, a digital audio recorder, a digital audio player, a digital picture recorder, a digital picture player, a digital video recorder, a digital video player, a device that can transmit and receive information in a wireless environment, one of various electronic devices constituting a home network, one of various electronic devices constituting a computer network, one of various electronic devices constituting a telematics network, an RFID (radio frequency identification) device, or one of various elements of a computing system.

As an example, the nonvolatile memory device 1100 or the memory system 1000 may be mounted as various types of packages. For example, the nonvolatile memory device 1100 or the memory system 1000 may be packaged and mounted as PoP (Package on Package), Ball grid arrays (BGAs), Chip scale packages (CSPs), Plastic Leaded Chip Carrier (PLCC), Plastic Dual In Line Package (PDIP), Die in Waffle Pack, Die in Wafer Form, Chip On Board (COB), Ceramic Dual In Line Package (CERDIP), Plastic Metric Quad Flat Pack (MQFP), Thin Quad Flatpack (TQFP), Small Outline (SOIC), Shrink Small Outline Package (SSOP), Thin Small Outline (TSOP), Thin Quad Flatpack (TQFP), System In Package (SIP), Multi Chip Package (MCP), Wafer-level Fabricated Package (WFP), Wafer-Level Processed Stack Package (WSP), or the like.

Figure 10:
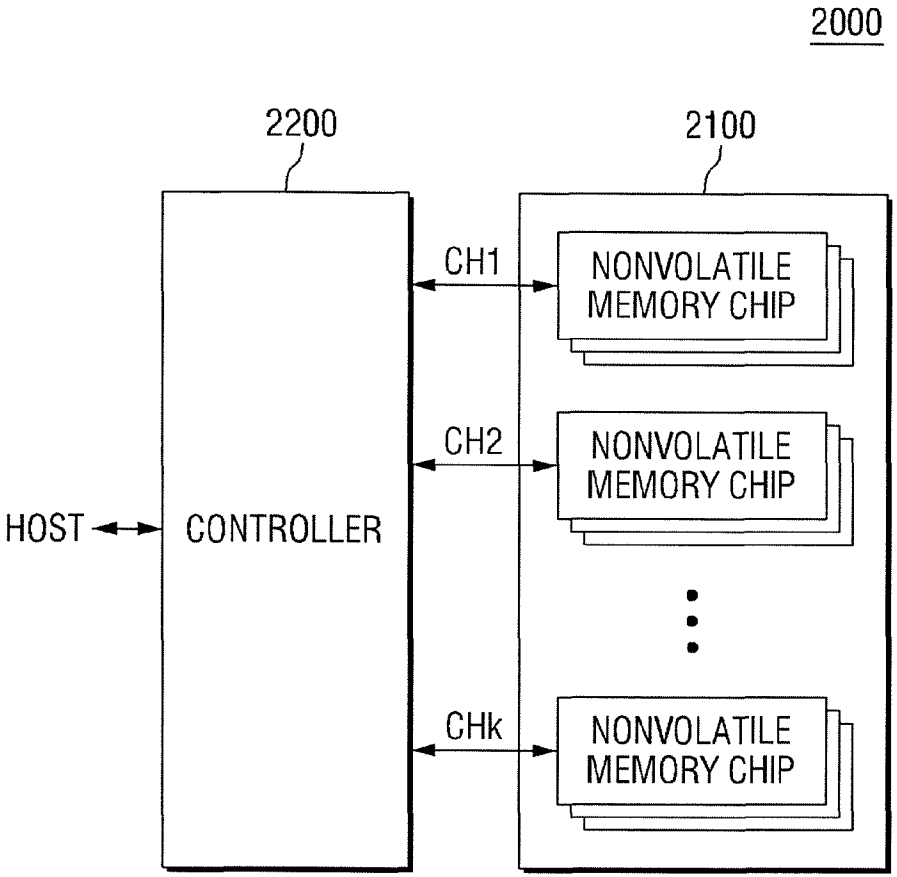
FIG. 10 is a block diagram illustrating an application example of the memory system of FIG. 9.

Next, referring to FIG. 10, a memory system 2000 includes a non-volatile memory device 2100 and a controller 2200. The nonvolatile memory device 2100 includes a plurality of nonvolatile memory chips. The plurality of memory chips are divided into a plurality of groups. The respective groups of the plurality of nonvolatile memory chips are configured to communicate with the controller 2200 through one common channel or different channels. For example, it is illustrated that the plurality of nonvolatile memory chips communicate with the controller 2200 through first to k-th channels CH1 to CHk.

In FIG. 10, it is described that the plurality of nonvolatile memory chips are connected to one channel. However, the memory system 2000 can be modified so that one nonvolatile memory chip is connected to one channel.

Figure 11:
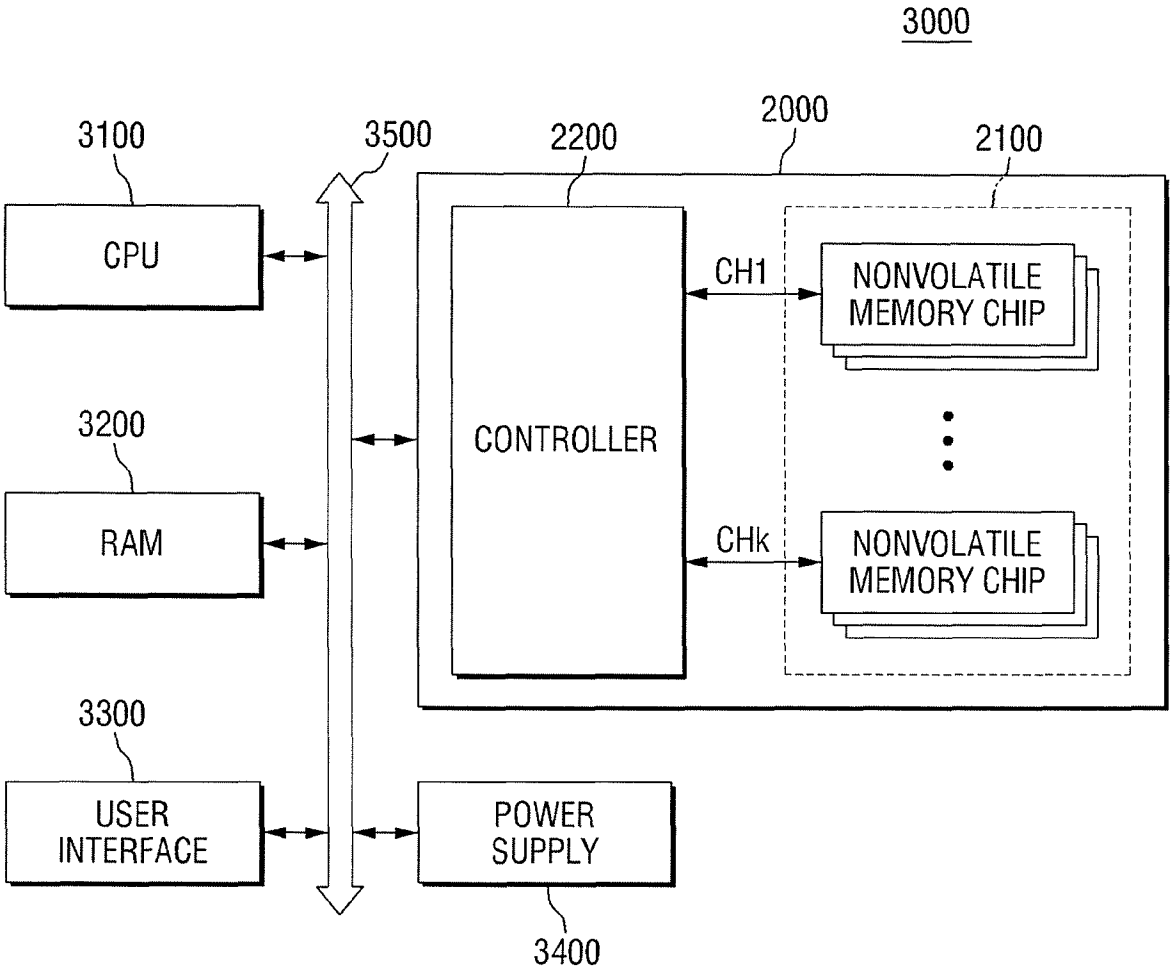
FIG. 11 is a block diagram illustrating a computing system including the memory system explained with reference to FIG. 10.

Next, referring to FIG. 11, a computing system 3000 includes a central processing unit 3100, a RAM (Random Access Memory) 3200, a user interface 3300, a power supply 3400, and the memory system 2000.

The memory system 2000 is electrically connected to the central processing unit 3100, the RAM 3200, the user interface 3300, and the power supply 3400 through a system bus 3500. Data which is provided through the user interface 3300 or is processed by the central processing unit 3100 is stored in the memory system 2000.

FIG. 11 illustrates that the nonvolatile memory device 2100 is connected to the system bus 3500 through the controller 2200. However, the nonvolatile memory device 2100 may be configured to be directly connected to the system bus 3500.

FIG. 11 illustrates that the memory system 2000 explained with reference to FIG. 10 is provided. However, the memory system 2000 may be replaced by the memory system 1000 explained with reference to FIG. 9.

For example, the computing system 3000 may be configured to include all the memory systems 1000 and 2000 explained with reference to FIGS. 9 and 10.

Although exemplary embodiments of the present inventive concept have been described for illustrative purposes, various modifications, additions and substitutions are possible, without departing from the scope and spirit of the inventive concept.

What is claimed is:

1. A circuit for generating a reference voltage, comprising:

a band gap circuit configured to generate a first current having a size that increases in proportion to an absolute temperature and a second current having a size that decreases in proportion to the absolute temperature, and output a reference voltage based on the first current and the second current;

a mirroring circuit configured to mirror a sum of the first current and the second current and outputting a mirroring voltage that is in proportion to the sum of the first current and the second current; and a start-up circuit configured to receive the mirroring voltage from the mirroring circuit and provide a driving current for generating the first current or the second current to the band gap circuit until a time when the first current starts to be generated in the band gap circuit, wherein the band gap circuit comprises a first transistor that is turned on at a time when the first current starts to be generated, and the start-up circuit comprises a replica circuit comprising a second transistor that is the same as the first transistor, a comparator configured to receive a replica voltage for turning on the second transistor from the replica circuit and the mirroring voltage from the mirroring circuit and compare sizes of the received voltages with each other, and a driving transistor configured to determine whether to provide the driving current to the band gap circuit in accordance with an output signal of the comparator, wherein the comparator provides the driving current to the band gap circuit by turning on the driving transistor when the mirroring voltage is lower than a sum of the replica voltage and a predetermined offset voltage, and the comparator is separated from the band gap circuit in operation by turning off the driving transistor when the mirroring voltage is higher than the sum of the replica voltage and the predetermined offset voltage.

2. The circuit for generating a reference voltage of claim 1, wherein the driving transistor comprises a PMOS transistor, wherein the comparator outputs a first output signal at a low-level signal to the PMOS transistor when the mirroring voltage is lower than the replica voltage, and wherein the comparator outputs a second output signal at a high-level signal to the PMOS transistor when the mirroring voltage is higher than the replica voltage.

3. The circuit for generating a reference voltage of claim 1, wherein the comparator comprises:

a third transistor having a gate terminal that receives the replica voltage and connected in series to an offset resistor that is related to the offset voltage; and a fourth transistor having a gate terminal that receives the mirroring voltage.

4. The circuit for generating a reference voltage of claim 3, wherein the third transistor and the fourth transistor are NMOS transistors.

5. The circuit for generating a reference voltage of claim 1, wherein the first transistor and the second transistor are P-type bipolar junction transistors.

6. The circuit for generating a reference voltage of claim 1, further comprising an operational amplifier that provides the driving current to the band gap circuit by turning on a switch included in the band gap circuit when the driving transistor is turned on.

7. The circuit for generating a reference voltage of claim 6, wherein the operational amplifier is self-biased.

8. The circuit for generating a reference voltage of claim 6, wherein the operational amplifier is biased by the driving current.

9. A circuit for generating a reference voltage, comprising:

a band gap circuit configured to output a reference voltage that is in proportion to a size of a driving current that flows through the band gap circuit when the size of the driving current is in a first range, and output a constant reference voltage when the size of the driving current is in a second range that is different from the first range; and a start-up circuit configured to provide the driving current to the band gap circuit until the driving current in the second range flows through the band gap circuit, wherein the band gap circuit comprises a first transistor that is turned on at a time when the first current starts to be generated, and the start-up circuit comprises a replica circuit comprising a second transistor that is the same as the first transistor, a comparator configured to receive a replica voltage for turning on the second transistor from the replica circuit and a mirroring voltage from a mirroring circuit and compare sizes of the received voltages with each other, and a driving transistor configured to determine whether to provide the driving current to the band gap circuit in accordance with an output signal of the comparator, wherein the comparator provides the driving current to the band gap circuit by turning on the driving transistor when the mirroring voltage is lower than a sum of the replica voltage and a predetermined offset voltage, and the comparator is separated from the band gap circuit in operation by turning off the driving transistor when the mirroring voltage is higher than the sum of the replica voltage and the predetermined offset voltage.

10. The circuit for generating a reference voltage of claim 9, wherein a size of a first driving current, which belongs to the first range, is smaller than a size of a second driving current, which belongs to the second range.

11. The circuit for generating a reference voltage of claim 10, wherein the driving current is a sum of a PTAT Proportional To Absolute Temperature (PTAT) current and a Complementary To Absolute Temperature (CTAT) current.

12. The circuit for generating a reference voltage of claim 11, further comprising the mirroring circuit configured to mirror the driving current and output the mirroring voltage that is in proportion to the size of the driving current.

13. A circuit for generating a direct current (DC) bias, comprising:

a bias generating circuit configured to generate internal first and second currents that are proportional to a temperature, and output the direct current DC bias based on the currents;

a current mirror circuit configured to output a mirroring voltage that is in proportion to a sum of the first current and the second current; and a start-up circuit configured to receive the mirroring voltage and apply a driving current to the bias generating circuit only until the first current reaches a predetermined level, wherein the bias generating circuit comprises a first transistor that is turned on at a time when the first current starts to be generated, and the start-up circuit comprises a replica circuit comprising a second transistor that is the same as the first transistor, a comparator configured to receive a replica voltage for turning on the second transistor from the replica circuit and a mirroring voltage from a mirroring circuit and compare sizes of the received voltages with each other, and a driving transistor configured to determine whether to provide the driving current to the bias generating circuit in accordance with an output signal of the comparator, wherein the comparator provides the driving current to the bias generating circuit by turning on the driving transistor when the mirroring voltage is lower than a sum of the replica voltage and a predetermined offset voltage and the comparator is separated from the bias generating circuit in operation by turning off the driving transistor when the mirroring voltage is higher than the sum of the replica voltage and the predetermined offset voltage.

14. The circuit for generating a DC bias of claim 13, wherein the first transistor is off until the first current reaches the predetermined level.

15. The circuit for generating a DC bias of claim 14, wherein the biasing generating circuit is connected between a power supply voltage and a ground voltage, and the driving transistor is connected between the power supply voltage and the mirroring voltage.

16. The circuit for generating a DC bias of claim 14, wherein the start-up circuit further comprises an operational amplifier configured to receive a voltage from the current mirror and a voltage from the bias generating circuit, and provide an output to the bias generating circuit.

* * * * *